US005921222A

United States Patent [19]

Freeland

[11] Patent Number: 5,921,222

[45] Date of Patent: Jul. 13, 1999

[54] VAPOR RECOVERY CONTROL SYSTEM FOR AN INTERNAL COMBUSTION ENGINE

[75] Inventor: Mark Freeland, Farmington Hills, Mich.

[73] Assignee: Ford Global Technologies, Inc., Dearborn, Mich.

[21] Appl. No.: 09/129,518

[22] Filed: Aug. 5, 1998

[51] Int. Cl.[6] ..... F02M 33/02

[52] U.S. Cl. ..... 123/520; 123/494

[58] Field of Search ..... 123/520, 521, 123/519, 518, 516, 198 D, 494

[56] References Cited

U.S. PATENT DOCUMENTS

| | | | |
|---|---|---|---|
| 4,962,744 | 10/1990 | Uranashi | 123/520 |
| 5,099,439 | 3/1992 | Saito | 123/520 |
| 5,113,834 | 5/1992 | Aramari | 123/520 |
| 5,139,001 | 8/1992 | Tada | 123/520 |
| 5,150,689 | 9/1992 | Yano et al. . | |
| 5,243,944 | 9/1993 | Blumenstock | 123/520 |
| 5,251,592 | 10/1993 | Seki | 123/520 |
| 5,363,832 | 11/1994 | Suzumura | 123/520 |
| 5,386,812 | 2/1995 | Curran | 123/520 |
| 5,390,644 | 2/1995 | Nunogaki | 123/520 |
| 5,482,023 | 1/1996 | Hunt | 123/520 |
| 5,592,922 | 1/1997 | Denz | 123/520 |
| 5,609,141 | 3/1997 | Matsuoka et al. . | |
| 5,623,914 | 4/1997 | Kawamoto et al. . | |
| 5,680,756 | 10/1997 | Harima . | |

*Primary Examiner*—Carl S. Miller
*Attorney, Agent, or Firm*—Neil P. Ferraro

[57] ABSTRACT

A system and method for controlling a vapor recovery system. The system uses a vapor sensor canister containing activated charcoal and two temperature probes. The sensor provides a differential temperature measurement that can be monitored and processed to determine hydrocarbon content in the vapor recovery system.

17 Claims, 3 Drawing Sheets

VAPOR RECOVERY CONTROL SYSTEM FOR AN INTERNAL COMBUSTION ENGINE

FIELD OF THE INVENTION

The invention relates to vapor recovery control systems for direct injection spark ignition (DISI) engines.

BACKGROUND OF THE INVENTION

In direct injection engines, the engine control system operates the engine in both a stratified mode and a homogeneous mode. In the stratified mode, which is typically used during low or mid load operation, the combustion chambers contain stratified layers of different air/fuel mixtures. The strata closest to the spark plug contains a stoichiometric mixture or a mixture slightly rich of stoichiometry, and subsequent strata contain progressively leaner mixtures. In the homogenous mode, which is typically used in medium or high load operation, a mixture with a relatively constant air/fuel ratio is present throughout the cylinder volume.

Fuel vapor recovery systems are employed on motor vehicles and need to be combined with direct injection engines to reduce atmospheric emissions of hydrocarbons by storing the hydrocarbons in a canister. The canister, which is coupled to the fuel tank, uses activated charcoal for absorbing the hydrocarbons. The canister is periodically purged by passing ambient air, which desorbs the hydrocarbons, through the charcoal. The resulting air and hydrocarbon mixture subsidizes the normal mixture of air, from the intake system, and fuel, from the fuel delivery system, inducted into the engine via the engine port. The canister is then able to again store hydrocarbons allowing the process to repeat.

In direct injection engines, purging is typically disabled when operating in the stratified mode. However, the fuel vapor recovery process must be executed at regular intervals to assure that the canister does not become saturated. Therefore, the engine must periodically operate in the homogeneous mode to purge even though there is no additional power requirement. Which means that operation in a stratified mode, which is advantageous for fuel economy, is limited by the necessity to purge the canister. Thus, it is advantageous to minimize the purging operation to the lowest acceptable level so that fuel economy can be maximized.

To minimize the purging operation, a measurement of canister saturation could be used so that the canister was purged only when necessary. One approach to monitoring the operating condition of the canister is to use a temperature sensor located in the canister. The temperature sensor senses a temperature rise or fall resulting from adsorption or regeneration, respectively. The temperature can then be monitored to determine the operating condition of the canister. The inlet of the canister is coupled directly to the fuel tank via a valve and the outlet of the canister is leads to the engine, with no hydrocarbon storage between the canister and the engine. Such a system is disclosed in U.S. Pat. No. 5,150,689.

The inventor herein has recognized numerous disadvantages when using the above system to determine when to stop purging operation, i.e., when the canister is emptied. For example, because the canister must be able to store a significant amount of hydrocarbon vapor, there is a relatively large amount of carbon resulting in a large time delay between the actual point of saturation and the resulting measured change in temperature. This large time delay causes less than optimal performance when trying to minimize purging operation.

Another disadvantage inherent in the system proposed in U.S. Pat. No. 5,150,689 is due to the configuration. In particular, vapors received by the canister directly from the fuel tank may or may not be saturated with hydrocarbons. This causes a disturbance in the temperature measurement used for detecting a canister saturation state. For example, the method described in U.S. Pat. No. 5,150,689 may result in a false representation of the state of the canister when there is change in the hydrocarbon content of the vapor entering the canister. In other words, the canister temperature of the canister may stop decreasing because of an increase in the hydrocarbon content of the vapor entering the canister from the fuel tank or because the canister is empty. Thus, the system may erroneously determine that the canister is empty when significant vapors are being generated in the fuel tank. This is a disadvantage because not only is the canister still partially full, but it will fill rapidly and possibly become oversaturated when purge flow is erroneously stopped.

Consequently, erroneous results will be obtained if using a temperature sensor located in a canister in which the primary purpose of the canister is to provide primary storage of hydrocarbons in vapor recovery systems.

SUMMARY OF THE INVENTION

An object of the invention claimed herein is to provide a system and method to determine the state of a carbon canister used in a vapor recovery system.

The above object is achieved, and disadvantages of prior approaches overcome, by providing a novel vapor recovery system coupled to an internal combustion engine. In one particular aspect of the invention, the system includes a relatively large, vapor storage canister capable of significant hydrocarbon storage and a relatively small, vapor sensor canister capable of minimal hydrocarbon storage. The vapor storage canister has a first opening communicating with atmosphere and a second opening. The system further includes a fuel tank communicating with the second opening of the vapor storage canister. The vapor sensor canister has a housing having a first opening communicating with the second opening of the vapor storage canister and the fuel tank and a second opening communicating with the engine. A differential temperature sensor is coupled to the vapor sensor canister for measuring a temperature difference between the first opening the said second opening of the vapor sensor canister. A controller estimates when fuel vapors passing through the vapor sensor canister from the fuel tank and the vapor storage canister have a hydrocarbon content below a predetermined threshold based on the differential temperature sensor.

By using a significantly smaller vapor sensor canister, which receives vapors from a fuel tank and a significantly larger vapor storage canister, and measuring the temperature drop across the vapor storage canister, the controller may correctly determine when to stop purging the vapor recovery system. In particular, the system will detect when the vapors from the fuel tank and the vapors from the vapor storage canister are below a threshold, and then stop the purging operation. Due to the above described arrangement, disturbances from the fuel tank occur. In this case, however, a positive result is obtained because it is desirable to continue purging when significant amounts of hydrocarbons are being generated in the fuel tank.

An advantage of the above aspect of the invention is that the vapor purging operation can be minimized.

Another advantage of the above aspect of the invention is improved fuel economy.

Other objects, features and advantages of the present invention will be readily appreciated by the reader of this specification.

BRIEF DESCRIPTION OF THE DRAWINGS

The object and advantages described herein will be more fully understood by reading an example of an embodiment in which the invention is used to advantage, referred to herein as the Description of the Preferred Embodiment, with reference to the drawings wherein.

BRIEF DESCRIPTION OF THE PREFERRED EMBODIMENT

Figure 1:
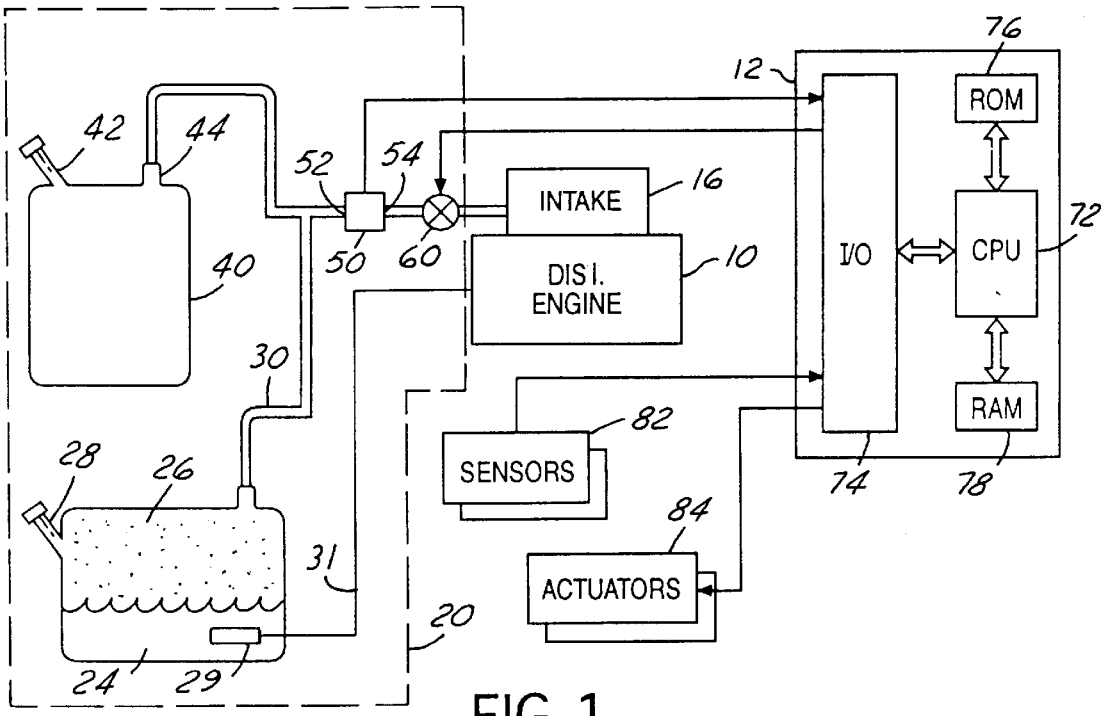
FIG. 1 is a block diagram of a vapor recovery system according to the present invention.

According to the present invention, direct injection spark ignition internal combustion engine 10 shown in FIG. 1, is controlled by electronic engine controller 12, both of which are housed in a vehicle (not shown). Engine 10 has intake manifold 16 for receiving fresh air charge and fuel vapors from vapor recovery system 20. Vapor recovery system 20 includes fuel tank 22 for containing liquid fuel 24 and fuel vapor 26. Fuel vapor 26 is a mixture of air and fuel. Fuel tank 22 also has filler tube 28 for allowing refueling. Fuel pump 29, disposed within tank 22 pumps fuel through fuel line 31 to engine 10, as is well known to those skilled in the art of direct injection engines. Fuel tank 22 communicates with fuel vapor line 30, which provides a path for fuel vapor 26 to travel to canister 40. Canister 40 is a conventional vapor storage carbon canister capable of storing hydrocarbon vapors. Canister 40 is sized to provide all of the necessary hydrocarbon storage capacity. The necessary hydrocarbon storage capacity is governed by various design factors, such as, for example, vehicle size; fuel tank size; engine size; and, various other factors known to those skilled in the art.

Continuing with FIG. 1, canister 40 has first opening 42 communicating with the atmosphere and second opening 44 communicating with fuel vapor line 30. Both canister 40 and fuel tank 22 communicate with inlet 52 of vapor sensor canister 50, which provides a measurement of hydrocarbon content of fuel vapor (as will be described later herein with particular reference to FIGS. 2 and 3) via fuel vapor line 30. Outlet 54 of vapor sensor canister 50 allows vapor sensor 50 to communicate with intake manifold 16 of engine 10 via purge vapor control valve 60.

Controller 12 is shown in FIG. 1 as a conventional microcomputer including: microprocessor unit 72, input/output ports 74, read only memory 76, random access memory 78, and a conventional data bus. Controller 12 is shown receiving various signals from sensors 82 in addition to temperature differential (ΔT) from vapor sensor canister 50 via temperature differential signal line 83. Controller 12 is also shown interfacing with various actuators 84 in addition to vapor control valve 60.

Figure 2:
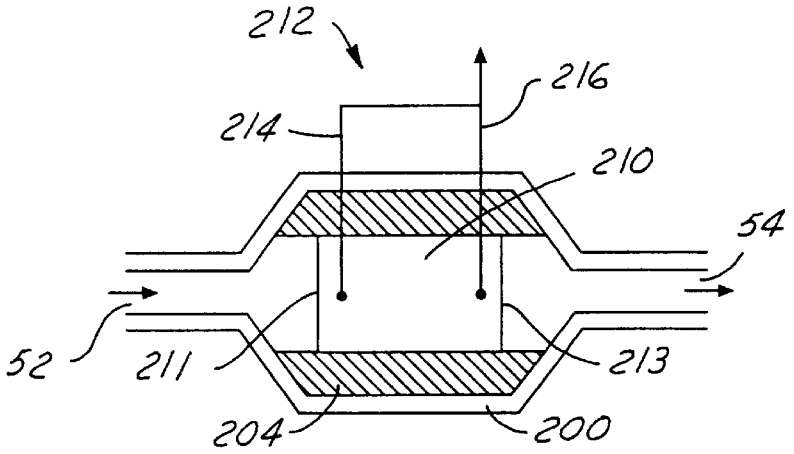
FIG. 2 is a schematic representation of a vapor sensor canister according to the present invention.

Referring now to FIG. 2, vapor sensor canister 50 is now described. Vapor sensor canister 50 has housing 200 with inlet 52 and outlet 54 disposed on either end of housing 200. Inlet 52 allows fuel vapor flow to enter housing 200, while outlet 54 allows fuel vapor to exit housing 200. Insulation 204 is located inside housing 200. Activated charcoal bed 210 is located inside insulation 204, such that flow entering inlet 52 must pass through charcoal bed 210 before exiting through outlet 54. Charcoal bed 210 is held in place by inlet screen 211 and outlet screen 213. Vapor sensor canister 50 also has temperature sensor 212 with inlet probe 214 and outlet probe 216. Inlet probe 214 measure the temperature of charcoal bed 210 near inlet 52, while outlet probe 216 measures the temperature of charcoal bed 210 near outlet 54. Temperature sensor 212 then provides differential temperature measurement (ΔT) to controller 12 via signal line 83, where temperature differential (ΔT) represents the difference in temperature between inlet probe 214 and outlet probe 216.

In a preferred embodiment, temperature sensor 212 comprises two thermocouples, the first being inlet probe 214 and the second being outlet probe 216. In this case, no cold reference junction is needed because only the differential temperature is needed. Further, only one sensor signal (one set of two wires) is needed for communication with controller 12.

The principal of operation of vapor sensor canister 50 is that active charcoal will heat up as it absorbs hydrocarbons and will cool down as it desorbs hydrocarbons. Thus, by measuring the temperature within a bed of active charcoal it is possible to determine if the bed is absorbing or desorbing hydrocarbons from the vapor stream passing through the bed. Examples of operation is now described for various circumstances.

If the vapor stream entering vapor canister sensor 50 is rich in hydrocarbons, the sensor will absorb some of the hydrocarbons from the vapor stream until the active charcoal in the sensor becomes saturated. The inlet temperature (Tin) will start to rise and then the outlet temperature (Tout) will start to rise after a small time delay ($\delta t_1$), which is due to the location of the temperature probe 214 being close to inlet 52 and temperature probe 216 being close to outlet 54. In this situation, the temperature differential (ΔT) will be positive because Tin>Tout. Then, once the vapor canister sensor's charcoal bed 210 is saturated with hydrocarbons (which occurs with a second small time delay ($\delta t_2$)), both Tin and Tout will start to fall again until they reach the temperature of the vapor stream (which again occurs with a third small time delay ($\delta t_3$)). As the temperatures fall, Tin will start to fall only slightly before Tout, thus ΔT will be close to zero. As the temperatures stabilize to the vapor temperature, ΔT will go to zero. Once the vapor canister sensor 50 has reached this state, it will be referred to as being "armed".

When the vapor stream becomes significantly lean in hydrocarbons, the sensor will desorb some of the hydrocarbons to the vapor stream until the active charcoal in the sensor becomes completely purged of hydrocarbons. In a similar manner to that described above, the desorbtion process will be most active near the inlet and thus Tin will start to fall below the vapor stream temperature. Tout will follow Tin with the small time delay ($\delta t_1$). In this situation, the temperature differential (ΔT) will be negative because Tin<Tout. Then, once the vapor canister sensor's charcoal bed 210 is completely purged of hydrocarbons (which occurs with the second small time delay ($\delta t_2$)), both Tin and Tout will migrate towards the temperature of the vapor stream (which again occurs with a third small time delay ($\delta t_3$)). As the temperatures migrate, Tin will start to migrate only slightly before Tout, thus ΔT will be close to zero. As the temperatures stabilize to the vapor temperature, ΔT will go to zero. Once the vapor canister sensor 50 has reached this state, it will be referred to as being "disarmed".

An important aspect of the operation of vapor sensor canister 50 is the small time delays previously described. As these time delays become larger, controller 12 receives more outdated information, which may cause excessive purging and thus less than optimal fuel economy. Therefore, vapor sensor canister 50 contains only a small amount of hydrocarbon storage capacity relative to canister 40. The small amount of hydrocarbon storage capacity allows time delay ($\delta t_1$) to be small. Further, the small amount of hydrocarbon storage capacity implies a small mass, which allows time delay ($\delta t_2$) to be small. Finally, the small amount of hydrocarbon storage capacity again allows time delay ($\delta t_3$) to be small.

Figure 3:
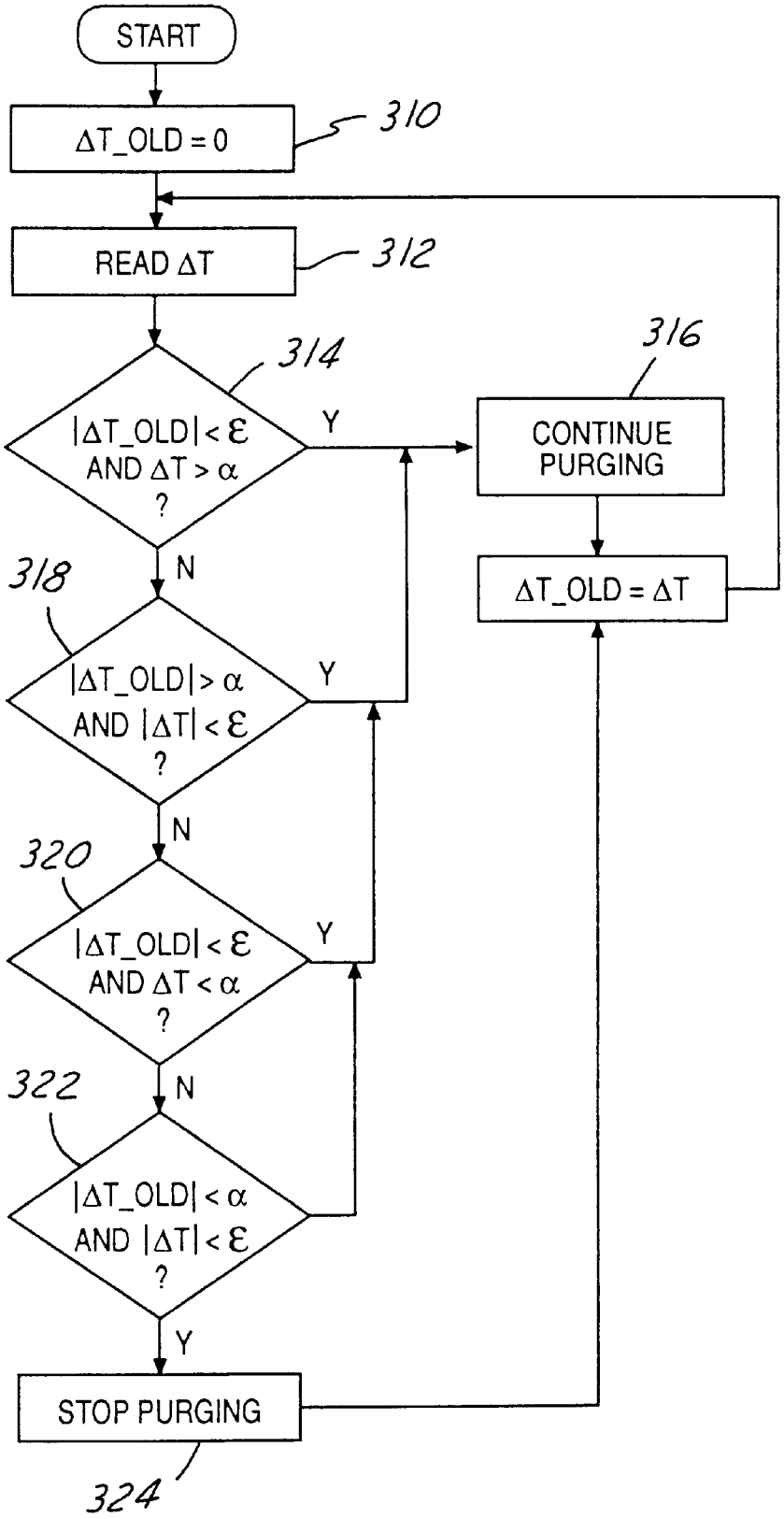
FIG. 3 is a high level flowchart of various operations performed by the embodiment of FIGS. 1 and 2.

Referring to FIG. 3, the routine for using vapor sensor canister 50 to determine when to stop purging is now described. The first time the routine is executed, old temperature differential ($\Delta T_OLD$) is set to zero in step 310. Then, in step 312, the current temperature differential ($\Delta T$) is read from vapor sensor canister 50. Then, in step 314, a determination is made as to whether the absolute value of the old temperature differential is less than a small parameter ($|T_OLD|<\epsilon$), which determines if the old temperature differential is close to zero, and whether the temperature differential is greater than a second small parameter ($\Delta T>\alpha$), which determines if the temperature differential is positive. When the answer in step 314 is YES, this indicates vapors containing hydrocarbons are entering vapor sensor canister 50 and purging operation is continued in step 316. Otherwise, in step 318, a determination is made as to whether the absolute value of the temperature differential is less than a small parameter ($|\Delta T|<\epsilon$), which determines if the temperature differential is close to zero, and whether the old temperature differential is greater than the second small parameter ($\Delta T_OLD>\alpha$), which determines if the old temperature differential is positive. When the answer in step 318 is YES, this indicates that vapors containing hydrocarbons are still entering vapor sensor canister 50 and purging operation is continued in step 316. Otherwise, in step 320, a determination is made as to whether the absolute value of the old temperature differential is less than a small parameter ($|\Delta T_OLD|<\epsilon$), which determines if the old temperature differential is close to zero, and whether the temperature differential is less than the negative of the second small parameter ($\Delta T\leftarrow\alpha$), which determines if the temperature differential is negative. When the answer in step 320 is YES, this indicates that vapors containing a low amount of hydrocarbons are entering vapor sensor canister 50 and purging operation is continued in step 316. Otherwise, in step 322, a determination is made as to whether the absolute value of the temperature differential is less than a small parameter ($|\Delta T|<\epsilon$), which determines if the temperature differential is close to zero, and whether the old temperature differential is less than the negative of the second small parameter ($\Delta T_OLD\leftarrow\alpha$), which determines if the old temperature differential is negative. When the answer in step 322 is NO, purging operation is continued in step 316. When the answer in step 322 is YES, this indicates that vapors containing a low amount of hydrocarbons are still entering vapor sensor canister 50 and purging operation is stopped in step 324. Once it has been determined to either continue to purge (step 316) or to stop purging (step 324), the old temperature differential is set to the temperature differential ($\Delta T_OLD=\Delta T$) and the routine repeats beginning with step 312.

Figure 4:
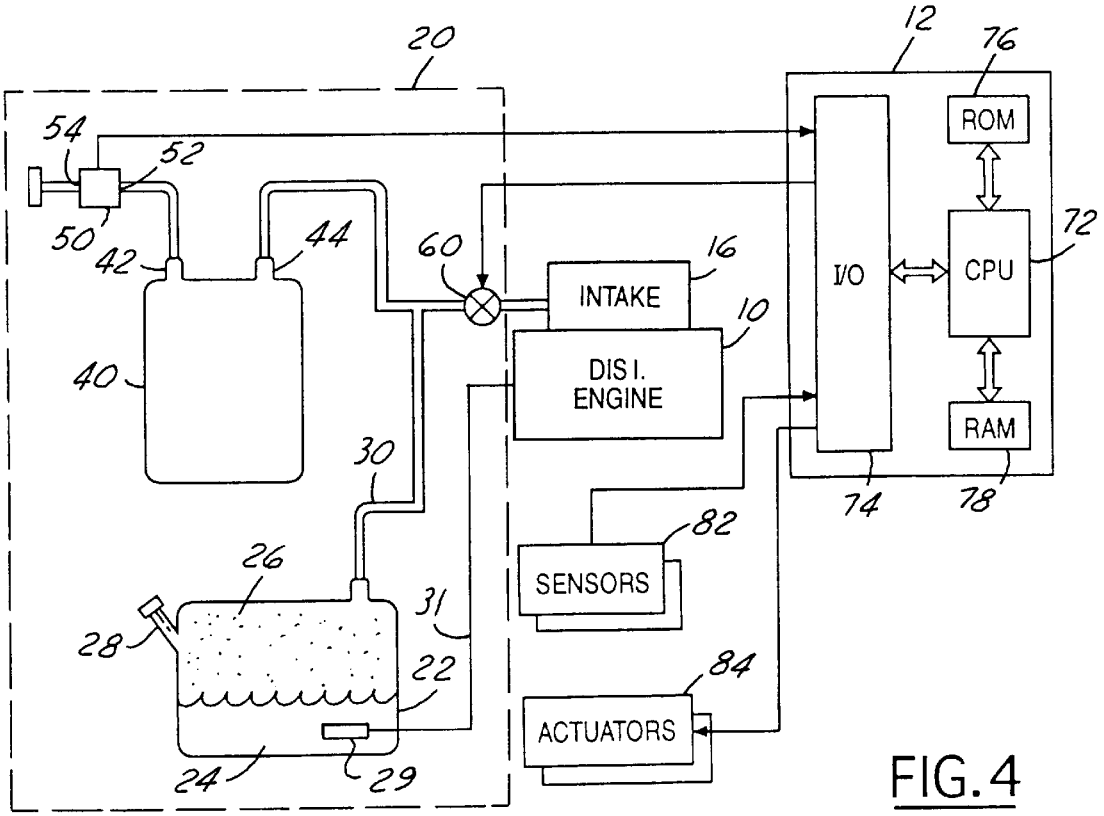
FIG. 4 is a block diagram of an alternative embodiment of a vapor recovery system according to the present invention.

Referring now to FIG. 4, an alternative embodiment of the present invention is shown in which vapor sensor canister 50 is located between first opening 42 and the atmosphere. Thus, in this configuration, vapor sensor canister 50 is used to determine when canister 40 is over saturated. This information can the be used to allow purging only when canister 40 is full as described later herein with particular reference to FIG. 5.

Figure 5:
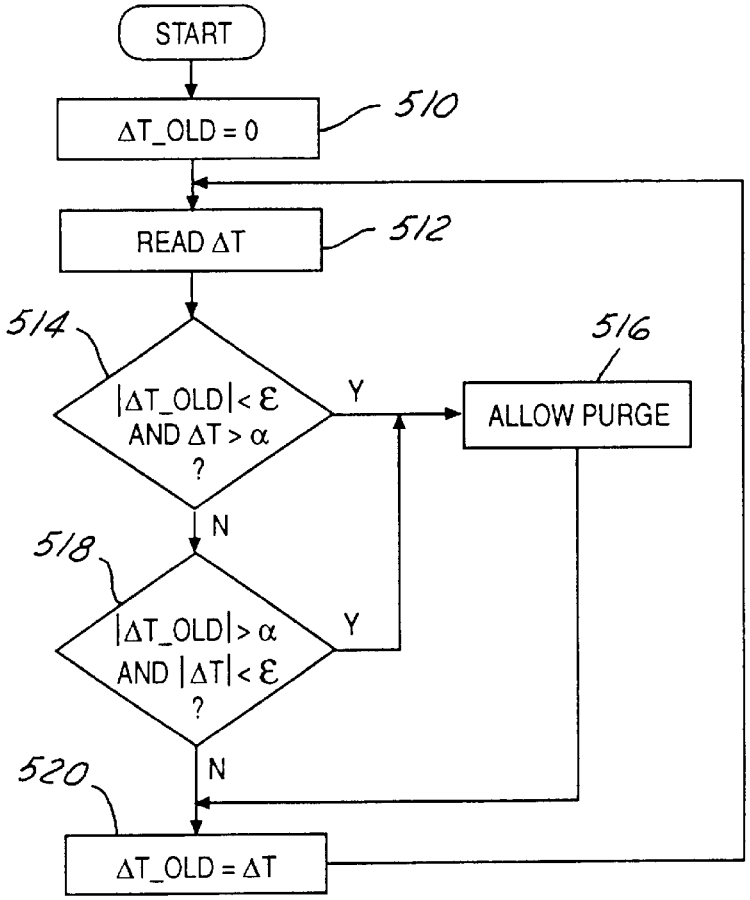
FIG. 5 is a high level flowchart of various operations performed by the alternative embodiment of FIG. 4.

Referring to FIG. 5, a routine for the alternative embodiment described with reference to FIG. 4 is now described. The first time the routine is executed, old temperature differential ($\Delta T_OLD$) is set to zero in step 510. Then, in step 512, the current temperature differential ($\Delta T$) is read from vapor sensor canister 50. Then, in step 514, a determination is made as to whether the absolute value of the old temperature differential is less than a small parameter ($|\Delta T_OLD|<\epsilon$), which determines if the old temperature differential is close to zero, and whether the temperature differential is greater than a second small parameter ($\Delta T>\alpha$), which determines if the temperature differential is positive. When the answer in step 514 is YES, this indicates that vapors containing hydrocarbons are entering vapor sensor canister 50 and purging operation is allowed in step 516. Otherwise, in step 518, a determination is made as to whether the absolute value of the temperature differential is less than a small parameter ($|\Delta T|<\epsilon$), which determines if the temperature differential is close to zero, and whether the old temperature differential is greater than the second small parameter ($\Delta T_OLD>\alpha$), which determines if the old temperature differential is positive. When the answer in step 518 is YES, this indicates that vapors containing hydrocarbons have been entering vapor sensor canister 50 and purging operation is allowed in step 516. Otherwise, in step 520, the old temperature differential is set to the temperature differential ($\Delta T_OLD=\Delta T$) and the routine repeats beginning with step 512.

While the best mode for carrying out the invention has been described in detail, those skilled in the art in which this invention relates will recognize various alternative designs and embodiments, including those mentioned above, in practicing the invention that has been defined by the following claims.

I claim:

1. A vapor recovery system coupled to an internal combustion engine, said system comprising:

a relatively large, vapor storage canister capable of significant hydrocarbon storage, with said vapor storage canister having a first opening communicating with atmosphere and a second opening;

a fuel tank in communication with said second opening of said vapor storage canister;

a relatively small, vapor sensor canister capable of minimal hydrocarbon storage, with said vapor sensor canister having a housing having a first opening communicating with said second opening of said vapor storage canister and said fuel tank and a second opening communicating with the engine;

a differential temperature sensor coupled to said vapor sensor canister for measuring a temperature difference between said first opening and said second opening of said vapor sensor canister;

a controller for estimating when fuel vapors passing through said vapor sensor canister from said fuel tank and said vapor storage canister have a hydrocarbon content below a predetermined threshold based on said differential temperature sensor.

2. The system recited in claim 1 wherein said controller further estimates when fuel vapors passing through said vapor sensor canister from said fuel tank and said vapor storage canister have said hydrocarbon content below said predetermined threshold based on a current value of said differential temperature sensor and a previous value of said temperature differential.

3. The system recited in claim 2 wherein said controller further estimates that fuel vapors passing through said vapor sensor canister from said fuel tank and said first canister have said hydrocarbon content below said predetermined threshold when said current value of said differential temperature sensor is substantially zero and said previous value of said temperature differential is substantially negative.

4. The system recited in claim 1 wherein said differential temperature sensor comprises a first thermocouple junction located near said first opening of said vapor sensor canister and a second thermocouple junction located near said second opening of said vapor sensor canister.

5. The system recited in claim 1 wherein said controller further discontinues purging operation based on said hydrocarbon content.

6. The system recited in claim 1 wherein said vapor sensor canister further comprises:

a charcoal bed located between said first opening and said second opening; and an insulation layer between said housing and said charcoal bed.

7. A vapor recovery system coupled to a direct injection internal combustion engine, said system comprising:

a relatively large, vapor storage canister capable of significant hydrocarbon storage, with said vapor storage canister having a first opening communicating with atmosphere and a second opening;

a fuel tank in communication with said second opening of said vapor storage canister;

a relatively small, vapor sensor canister capable of minimal hydrocarbon storage, with said vapor sensor canister having a housing having a first opening communicating with said second opening of said vapor storage canister and said fuel tank and a second opening communicating with the engine;

a differential temperature sensor coupled to said vapor sensor canister for measuring a temperature difference between said first opening and said second opening of said vapor sensor canister;

a controller for estimating that fuel vapors passing through said vapor sensor canister from said fuel tank and said vapor storage canister have a hydrocarbon content below a predetermined threshold when a current value of said differential temperature sensor is substantially zero and a previous value of said temperature differential is substantially negative.

8. The system recited in claim 7 wherein said differential temperature sensor comprises a first thermocouple junction located near said first opening of said vapor sensor canister and a second thermocouple junction located near said second opening of said vapor sensor canister.

9. The system recited in claim 7 wherein said controller further discontinues purging operating based on said hydrocarbon content.

10. The system recited in claim 7 wherein said vapor sensor canister further comprises:

a charcoal bed located between said first opening and said second opening; and an insulation layer between said housing and said charcoal bed.

11. The system recited in claim 7 further comprising a control valve disposed between said second opening of said vapor sensor canister and the engine.

12. A vapor recovery system coupled to an internal combustion engine, said system comprising:

a first, relatively small, canister capable of minimal hydrocarbon storage, with said first canister having a housing having a first opening communicating with atmosphere and a second opening;

a second, relatively large, canister capable of significant hydrocarbon storage, with said second canister having a first opening communicating with said second opening of said first canister and a second opening communicating with the engine;

a fuel tank in communication with said second opening of said second canister;

a differential temperature sensor coupled to said first canister for measuring a temperature difference between said first opening and said second opening of said first canister;

a controller for estimating that fuel vapors passing through said first canister from said second canister have a hydrocarbon content above a predetermined threshold when a current value of said differential temperature sensor is substantially positive and a previous value of said temperature differential is substantially zero.

13. The system recited in claim 12 wherein said controller further estimates that fuel vapors passing through said first vapor sensor canister from said second canister have a hydrocarbon content above a predetermined threshold when a current value of said differential temperature sensor is substantially zero and a previous value of said temperature differential is substantially positive.

14. The system recited in claim 12 wherein said differential temperature sensor comprises a first thermocouple junction located near said first opening of said first canister and a second thermocouple junction located near said second opening of said first canister.

15. The system recited in claim 12 wherein said first vapor sensor canister further comprises:

a charcoal bed located between said first opening and said second opening; and an insulation layer between said housing and said charcoal bed.

16. The system recited in claim 12 further comprising a control valve disposed between said second opening of said second canister and the engine.

17. A method for controlling a purging operation of a vapor storage canister in a vapor recovery system, with the system having a relatively large vapor storage canister capable of significant hydrocarbon storage coupled to a fuel tank and a relatively small vapor sensor canister capable of minimal hydrocarbon storage, said relatively small vapor sensor canister having an inlet and an outlet, with the small vapor sensor canister being coupled to the vapor storage canister, with said method comprising the steps of:

sensing a temperature of the vapor sensor canister near said inlet;

sensing a temperature of the vapor sensor canister near said outlet;

determining a differential temperature therebetween; and estimating when fuel vapors passing through said vapor sensor canister from said fuel tank and said vapor storage canister have a hydrocarbon content below a predetermined threshold based on said differential temperature.

* * * * *